US007490440B2

(12) United States Patent
Batty

(10) Patent No.: US 7,490,440 B2
(45) Date of Patent: Feb. 17, 2009

(54) SUPPORT DEVICE FOR A RIB

(75) Inventor: Derrek William Batty, 3 Robert Hoddle Grove, Mudgee, NSW 2850 (AU)

(73) Assignees: Derrek William Batty, Mudgee NSW (AU); Richard Durman Hooper, Mudgee NSW (AU)

( * ) Notice: Subject to any disclaimer, the term of this patent is extended or adjusted under 35 U.S.C. 154(b) by 862 days.

(21) Appl. No.: 10/663,438

(22) Filed: Sep. 16, 2003

(65) Prior Publication Data

US 2005/0257448 A1 Nov. 24, 2005

(30) Foreign Application Priority Data

Sep. 18, 2002 (AU) ..... 2002951470

(51) Int. Cl.
*E04G 25/00* (2006.01)
*E04G 21/26* (2006.01)
*E04G 23/04* (2006.01)

(52) U.S. Cl. ..... 52/127.2; 52/127.3; 299/11; 299/12; 248/200.1; 248/560; 248/576; 254/10.5; 254/16; 405/132; 405/133; 405/290; 405/292

(58) Field of Classification Search ..... 52/698, 52/127.3, 127.2; 405/288, 290, 291, 292, 405/296, 297, 272, 132, 133; 299/11, 12; 33/561.1–561.3; 254/10.5, 16, 133 A; 248/560, 248/576, 200.1; 292/259 R; 410/143; 454/168, 454/170

See application file for complete search history.

(56) References Cited

U.S. PATENT DOCUMENTS 1,229,323 A * 6/1917 Roby ..... 405/288
1,576,521 A * 3/1926 Laser ..... 269/95
1,766,324 A * 6/1930 Berner ..... 454/170
2,068,491 A * 1/1937 Jakoubek et al. ..... 248/357
2,138,494 A * 11/1938 Knox ..... 33/561.2
2,556,357 A * 6/1951 Baldwin ..... 173/35
3,126,708 A * 3/1964 Jasper ..... 405/288
3,206,187 A * 9/1965 Cagley ..... 160/123
3,636,852 A * 1/1972 Burgess, Jr. ..... 454/170
3,747,503 A * 7/1973 Lovell ..... 454/170
3,863,420 A * 2/1975 Peiffer et al. ..... 52/749.15
3,891,275 A * 6/1975 Spies ..... 299/32
4,091,628 A * 5/1978 Kelley ..... 405/290
4,173,421 A * 11/1979 Harhoff et al. ..... 405/291
4,334,800 A * 6/1982 Stuckmann ..... 405/145
4,349,300 A * 9/1982 Kelley ..... 405/288

(Continued)

*Primary Examiner*—Jeanette Chapman
(74) *Attorney, Agent, or Firm*—Ladas & Parry LLP

(57) ABSTRACT

A support device (8) for a rib (14) between a floor (18) and a roof (16). The device includes an expansion means (10) and a pair of resilient members (12*a*, 12*b*). Each of the resilient members (12*a*, 12*b*) have a proximal end (27*a*, 27*b*) adapted for connection to the expansion mean (10) and a distal end (28*a*, 28*b*) curved away from the expansion means (10) and adapted for engagement with the floor (18) and roof (16) respectively. When the device (8) is positioned towards or against the rib (16) and the expansion means (10) is activated to drive the members (12*a*, 12*b*) apart, the member's distal ends (28*a*, 28*b*) are driven substantially vertically into engagement with the floor (18) and the roof (16) and a portion of the device (8) is driven substantially laterally (32) into abutment against the rib (14).

20 Claims, 2 Drawing Sheets

U.S. PATENT DOCUMENTS 4,770,086 A * 9/1988 Gabster ..... 454/170
4,997,317 A * 3/1991 Schonfeld et al. ..... 405/288
5,103,531 A * 4/1992 Perrotta ..... 16/87.4 R
5,316,407 A * 5/1994 Miller ..... 404/25
5,564,866 A * 10/1996 Snyder ..... 405/288
5,683,294 A * 11/1997 Maines ..... 454/170
5,890,856 A * 4/1999 Huang ..... 410/151
5,934,990 A * 8/1999 Steffenino et al. ..... 454/170
6,102,628 A * 8/2000 Maity et al. ..... 405/288
6,216,287 B1 * 4/2001 Wise ..... 4/610
6,368,037 B1 * 4/2002 Oliviero et al. ..... 410/151
6,499,916 B2 * 12/2002 Marianski et al. ..... 405/288
6,694,543 B2 * 2/2004 Moore ..... 4/610
6,733,220 B2 * 5/2004 Brown et al. ..... 410/151
7,114,888 B2 * 10/2006 Stankus et al. ..... 405/288
7,263,746 B2 * 9/2007 Neuhaus et al. ..... 24/279
2005/0268394 A1 * 12/2005 Monk et al. ..... 4/558
2007/0174956 A1 * 8/2007 Heaslip ..... 4/558

* cited by examiner

SUPPORT DEVICE FOR A RIB

FIELD OF THE INVENTION

The present invention relates to a support device for a rib (wall) between a floor and a roof.

The present invention has been developed primarily for use in supporting ribs either side of a mining roadway.

BACKGROUND OF THE INVENTION

Underground roadways of different widths are driven into geological seams dependent on the characteristics of the seam itself and various mining regulations. Due to horizontal and vertical pressures, strata conditions, depth of seam, geological anomalies and other circumstances these roadways are prone to varying degrees of failure.

Known methods of supporting the roadway ribs to prevent failure include timber, steel or plastic mesh pinned with rib bolts, and various concrete products. These can be installed prior to or after mining activity to assist with support and stabilization.

A disadvantage with these rib supports is that they cause lost production time during installation. A further disadvantage is that these devices can not be installed until a section of roadway is completed, and can thus expose mine workers to unsupported, potentially hazardous ribs for extended periods of time.

OBJECT OF THE INVENTION

It is an object of the present invention to substantially overcome or at least ameliorate one or more of the above disadvantages of the prior art, or at least to provide a useful alternative to existing rib supports.

SUMMARY OF THE INVENTION

In a first aspect, the present invention provides a support device for a rib between a floor and a roof, the device including;

an expansion means; and a pair of resilient members each having a proximal end adapted for connection to the expansion means and a distal end curved away from the expansion means and adapted for engagement with the floor and roof respectively, wherein when the device is positioned towards or against the rib and the expansion means is activated to drive the members apart, the members distal ends are driven substantially vertically into engagement with the floor and the roof and a portion of the device is driven substantially laterally into abutment against the rib.

In a second aspect, the present invention provides a support device, the device comprising:

an expander; and a pair of resilient members each having a proximal end adapted for connection to the expander and a distal end curved away from the expander.

In one embodiment, the expansion mean is mechanically operable to selectively permit or inhibit tensioning of the rib support.

In another embodiment, the expansion means is hydraulically operable to selectively permit or inhibit tensioning of the rib support.

The distal ends of the resilient members preferably have saw-tooth profiles.

The resilient members are preferably made from pre-curved spring steel.

In a preferred embodiment, the device includes locking means adapted to lock the resilient members in engagement with the floor and roof after activation of the expansion means.

In one form, the locking means is fixed to the support device. In another form, the locking means is removable from the support device.

BRIEF DESCRIPTION OF THE DRAWINGS

A preferred embodiment of the invention will now be described, by way of example only, with reference to the accompanying drawings in which.

DETAILED DESCRIPTION OF THE PREFERRED EMBODIMENTS

Figure 1:
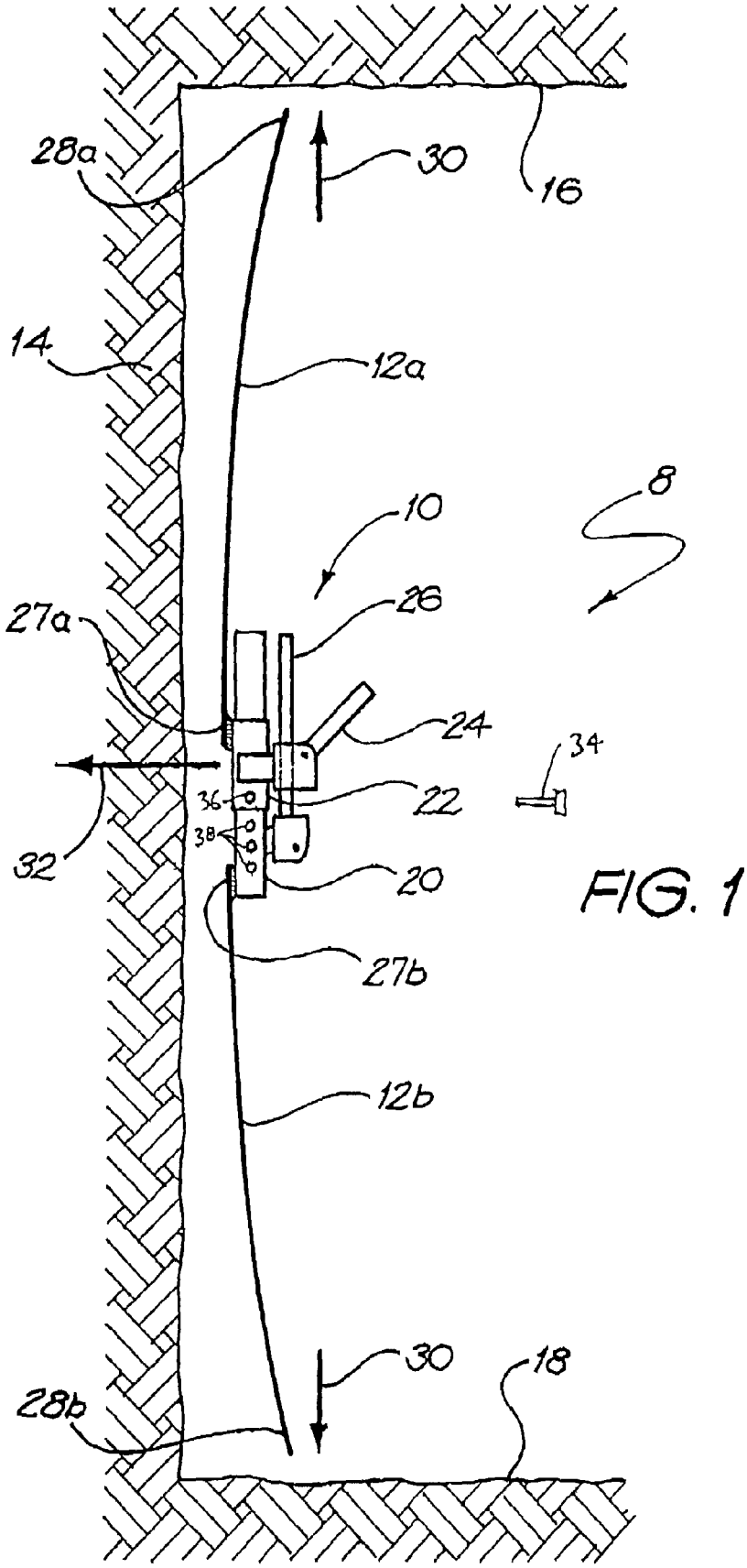
FIG. 1 is a side view of an embodiment of a support device according to the present invention, in a disengaged position.
Figure 2:
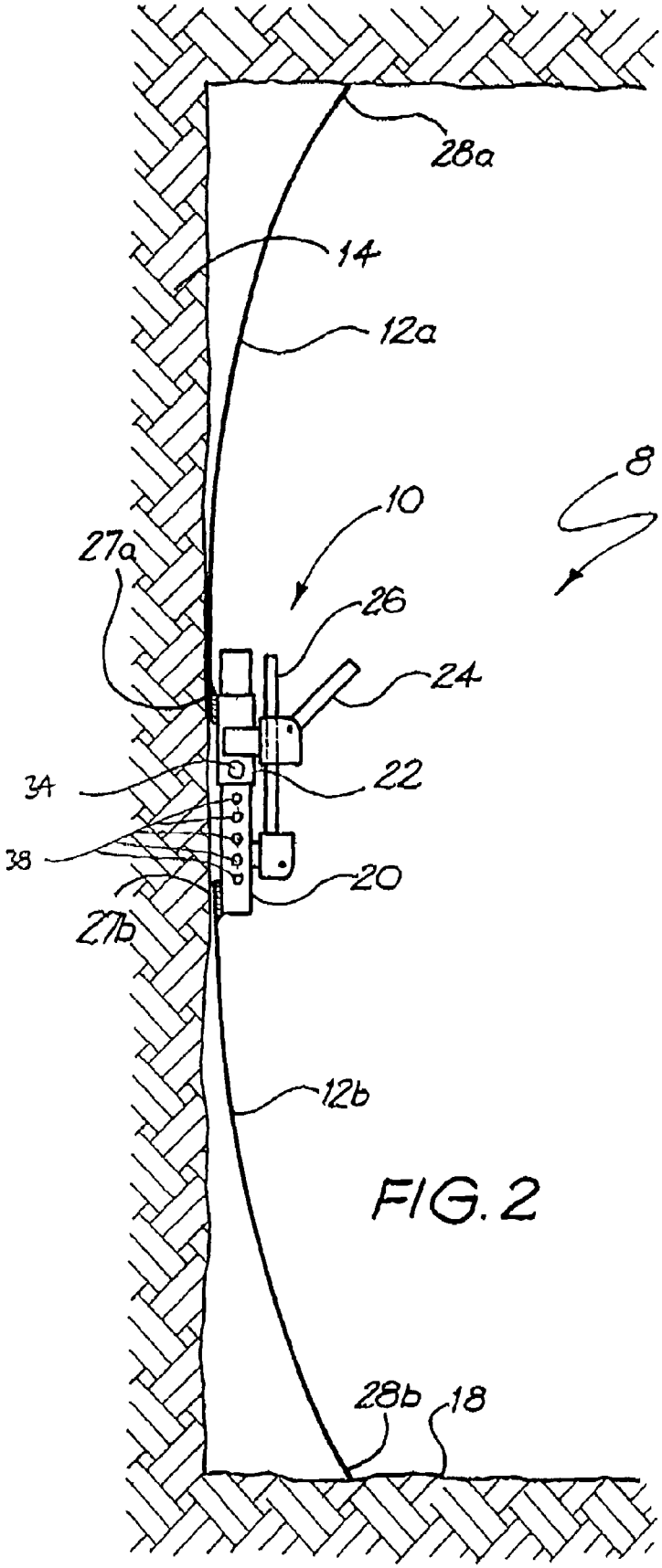
FIG. 2 is a side view of the support device shown in FIG. 1 in an engaged position.
Figure 3:
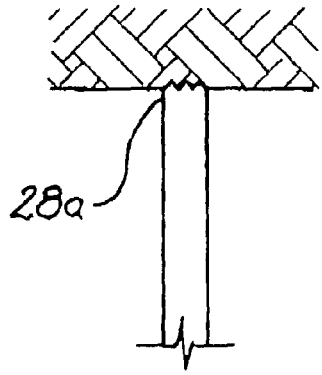
FIG. 3 is a partial front view of the device shown in FIG. 2.

FIGS. 1, 2 and 3 show an embodiment of a support device, generally indicated by the reference numeral 8, according to the invention. The device 8 includes an expansion means (expander) 10 that includes an inner square hollow section (SHS) steel member 20 that slides within an outer SHS steel member 22. The expansion means 10 also includes a jacking arrangement welded to the member 22, that includes a jacking lever 24, and a ratchet device 26 welded to the first member 20.

The device 8 also includes a pair of curved resilient members 12*a*, 12*b* formed from pre-curved spring steel. Both of the members 12*a* and 12*b* are welded to the members 20 and 22 respectively at their proximal ends 27*a* and 27*b*.

The resilient members 12*a* and 12*b* are oppositely extending and have distal ends 28*a*, 28*b* curved away from the expansion means 10. The distal ends 28*a*, 28*b* (as best seen in FIG. 3) terminate with a saw-tooth profile.

The operation of the device 8 will now be described. In use, the support device 8 is positioned such that the distal ends 28*a*, 28*b* of each of the resilient members 12*a*, 12*b* are placed near the floor 18 and roof 16 respectively of an underground roadway and close to the rib 14. The device 8 is oriented such that the distal ends 28*a*, 28*b* of the resilient members 12*a*, 12*b* curve away from the rib 14.

The jacking lever 24 is then manually operated such that a pawl (not shown) engages with the ratchet device 26 to effect relative expanding movement between the members 20 and 22. This movement drives the resilient members 12*a*, 12*b* away from each other, in the directions indicated by vertical arrows 30 in FIG. 1, and drives the ends 28*a* and 28*b* of the resilient members 12*a* and 12*b* into engagement with the floor 18 and roof 16 respectively, as shown in FIG. 2. The saw-tooth profile of the members distal ends 28*a* and 28*b* assists them in securely engaging with the roof 16 and floor 18.

Further operation of the jag lever 24 results in the members 12*a*, 12*b*, bowing under tension towards the rib 14 which drives a portion of the device 8 adjacent the expansion means 10 laterally, in the direction of horizontal arrow 32 in FIG. 1, into abutment against the rib 14. As the device 8 is forced into abutment against the rib 14, it thereby resists movement of the rib 14 in the opposite direction to the arrow 32 and advantageously provides support against failure of the rib 14 in that opposite direction. A number of the devices 8 would typically be placed spaced apart along a section of roadway need support.

As described above, an advantage of the device 8 is it can be quickly and easily locked into a position supporting of the rib 14.

Another advantage of the device 8 is it can be also used with other rib support systems (ie. steel or plastic mesh) interposed between the device 8 and the rib 14 and offer support with or without the installation of rib bolts.

Another advantage of the device 8 is that if any lateral movement of the rib 14 occurs during use, the distal ends of the resilient members 12*a*, 12*b* are forced more strongly into the floor 18 and roof 16 which assists in retaining the device 8 in position.

A further advantage of support device 8 is that it can be easily and quickly retracted from the rib 14 by releasing the ratchet device 26 for re-use at a later stage in the mining cycle or, alternatively, left as a permanent support.

In other embodiments of the invention (not shown), the expansion means 10 can be activated to expand by other mechanical components (such as screws), hydraulically (such as hydraulic cylinders) or pneumatically (such as, pneumatic cylinders), In another embodiment (not shown), the expansion means 10 can be disengaged from the remainder of the support device 8, after the resilient members 12*a* and 12*b* have been driven into engagement with the roof 16 and floor 18. As an example, each member 20 and 22 can include one or more holes spaced along it's length. A pin 34 or other such fastener can be inserted through two corresponding holes 36, 38 (when aligned) in the members 20 and 22 respectfully to lock the support device 8 in an engaged/abutted position. This permits a single expansion means 10 to be disengaged and utilised during the expansion and placement of multiple rib support devices 8.

Although the invention has been described with reference to specific examples, it will be appreciated by those skilled in the art that the invention may be embodied in many other forms.

The claim defining the invention are as follows:

1. A system comprising (a) a support device for use between a floor, a rib and a roof when the rib is disposed between the floor and roof and is substantially perpendicular to each of the floor and roof, said support device comprising:

an expander; and a pair of resilient members each having a proximal end adapted for connection to the expander and a distal end curved away from the expander;

wherein said expander is linearly expandable to drive the distal ends of said pair of resilient members away from each other in opposed directions such that, upon linear expansion of the expander with the support device disposed between the floor, rib and roof, the expander can drive the distal ends of said pair of resilient members into engagement with the floor and the roof so that the resilient members bow and cause a portion of said support device to be driven into abutment against the rib in a direction that is substantially transverse to the opposed directions; and (b) a rib, a floor and a roof of a mining roadway, the rib being disposed between the floor and roof and being substantially perpendicular to the floor and roof, the support device being disposed between the floor, the rib and the roof.

2. The system as claimed in claim 1, wherein the expander comprises an inner member 20 that slides within an outer member 22.

3. The system as claimed in claim 2, wherein the inner member 20 is straight.

4. The system as claimed in claim 1, wherein the expander comprises expansion means for selective linear movement of the expander between an expanded configuration which permits tensioning of the support device against the rib and an unexpanded configuration which inhibits the tensioning.

5. The system as claimed in claim 1, wherein the distal ends of the resilient members have sawtooth profiles.

6. The system as claimed in claim 1, wherein the resilient members are made from pre-curved spring steel.

7. The system as claimed in claim 4, comprising locking means for selectively locking the expander in either the expanded or unexpanded configuration.

8. The system as claimed in claim 7, wherein the locking means is fixed to the support device.

9. The system as claimed in claim 7, wherein the locking means is detachable from the support device.

10. A support device for use between a floor, a rib and a roof, the support device comprising:

an expander;

a pair of resilient members, each of the resilient members having a proximal end for connection to the expander and a distal end that curves away from the expander with the proximal end connected to the expander; and a lock for locking the expander in an expanded configuration whereby the pair of resilient members can be locked in engagement with the floor and roof respectively with the expander in the expanded configuration.

11. The support device as claimed in claim 10, wherein the expander comprises expansion means for selective linear movement of the expander between the expanded configuration which permits tensioning of the support device against the rib and an unexpanded configuration which inhibits the tensioning.

12. The support device as claimed in claim 10, wherein the distal end of each of the resilient members has a sawtooth profile.

13. The support device as claimed in claim 10, wherein the resilient members are made from pre-curved spring steel.

14. The support device as claimed in claim 10, wherein the lock is fixed to the support device.

15. The support device as claimed in claim 10, wherein the lock is detachable from the support device.

16. The support device as claimed in claim 11, wherein the expander comprises an inner member 20 that slides within an outer member 22.

17. The support device as claimed in claim 11, wherein the inner member 20 is straight.

18. A system comprising: (a) the support device of claim 11, and (b) a rib, a floor and a roof of a mining roadway, the rib being disposed between the floor and roof and being substantially perpendicular to the floor and roof, the support device being disposed between the floor, the rib and the roof.

19. A support device for use between a floor, a rib and a roof when the rib is disposed between the floor and roof and is substantially perpendicular to each of the floor and roof, said support device comprising:

an expander; and a pair of resilient members each having a proximal and adapted for connection to the expander and a distal end curved away from the expander, the distal ends of the resilient members having sawtooth profiles; and wherein said expander is linearly expandable to drive the distal ends of said pair of resilient members away from each other in opposed directions such that, upon linear expansion of the expander with the support device disposed between the floor, rib and roof, the expander can drive the distal ends of said pair of resilient members into engagement with the floor and the roof so that the resilient members bow and cause a portion of said support device to be driven into abutment against the rib in a direction that is substantially transverse to the opposed directions.

20. A support device for use between a floor, a rib and a roof when the rib is disposed between the floor and roof and is substantially perpendicular to each of the floor and roof, said support device comprising:

an expander; and a pair of resilient members each having a proximal and adapted for connection to the expander and a distal end curved away from the expander, the resilient members being made from pre-curved spring steel, wherein said expander is linearly expandable to drive the distal ends of said pair of resilient members away from each other in opposed directions such that, upon linear expansion of the expander with the support device disposed between the floor, rib and roof, the expander can drive the distal ends of said pair of resilient members into engagement with the floor and the roof so that the resilient members bow and cause a portion of said support device to be driven into abutment against the rib in a direction that is substantially transverse to the opposed directions.

* * * * *